US010883285B1

(12) United States Patent
Zherlo et al.

(10) Patent No.: US 10,883,285 B1
(45) Date of Patent: Jan. 5, 2021

(54) TILE SPACER AND WEDGE

(71) Applicants: Anatoliy Zherlo, Panama City Beach, FL (US); Denys Nekrasov, Santa Rosa Beach, FL (US)

(72) Inventors: Anatoliy Zherlo, Panama City Beach, FL (US); Denys Nekrasov, Santa Rosa Beach, FL (US)

( * ) Notice: Subject to any disclaimer, the term of this patent is extended or adjusted under 35 U.S.C. 154(b) by 0 days.

(21) Appl. No.: 16/677,793

(22) Filed: Nov. 8, 2019

(51) Int. Cl.
*E04F 21/00* (2006.01)
*E04G 21/18* (2006.01)

(52) U.S. Cl.
CPC ..... *E04G 21/1883* (2013.01)

(58) Field of Classification Search
CPC ..... E04F 21/0092; E04F 15/02022; E04G 21/1883; Y10S 33/20
See application file for complete search history.

(56) References Cited

U.S. PATENT DOCUMENTS

| | | | | |
|---|---|---|---|---|
| 2,930,135 | A | 3/1960 | Rodtz, Sr. | |
| 5,010,654 | A | 4/1991 | Funes, Jr. | |
| 5,201,130 | A | 4/1993 | Krchnak | |
| 5,623,799 | A | 4/1997 | Kowlaski et al. | |
| D385,167 | S * | 10/1997 | Weber | D8/47 |
| 6,874,242 | B2 | 4/2005 | Shilo et al. | |
| D542,161 | S | 5/2007 | Skillings | |
| 7,475,488 | B2 | 1/2009 | Symington | |
| 7,818,923 | B2 | 10/2010 | Alvarez | |
| 8,082,714 | B2 | 12/2011 | Burns et al. | |
| 8,919,076 | B1 | 12/2014 | Kitchens | |
| D833,260 | S | 11/2018 | Dumlao et al. | |
| D875,504 | S * | 2/2020 | Schluter | D8/354 |
| 2005/0214502 | A1 | 9/2005 | Westhorp | |
| 2006/0144011 | A1* | 7/2006 | Symington | E04F 21/0092 52/782.1 |
| 2015/0197946 | A1 | 7/2015 | Tooma | |
| 2016/0090746 | A1* | 3/2016 | Sighinolfi | E04F 21/0092 33/526 |
| 2019/0383027 | A1* | 12/2019 | Sighinolfi | E04F 21/22 |
| 2020/0056381 | A1* | 2/2020 | Castellanos | E04F 21/0092 |
| 2020/0224434 | A1* | 7/2020 | Troxell | E04F 21/0092 |
| 2020/0318364 | A1* | 10/2020 | Giannunzio | E04F 21/22 |

* cited by examiner

*Primary Examiner* — Gisele D Ford
(74) *Attorney, Agent, or Firm* — Peter Loffler

(57) ABSTRACT

A combination tile spacer and wedge uses a truncated pentagon shaped body that has a first side edge and a corresponding second side edge that is thicker than the first side edge. A rectangular solid shaped riser rises from a ridge located on an upper surface of the body. The thickness of the riser is greater than that of the second side edge. A rectangular extension extends rearwardly from the riser and has a thickness that is greater than that of the second side edge and less than that of the riser. The nose or front portion of the body tapers downwardly from upper to lower surface to a front edge that is parallel with the back edge. The thickness of the front edge is less than that of the first side edge. Inwardly directed diagonal edges connect the first and second side edges with the front edge.

6 Claims, 9 Drawing Sheets

TILE SPACER AND WEDGE

BACKGROUND OF THE INVENTION

1. Field of the Invention

The present invention relates to a tile spacer that has multiple edges, each edge having a different thickness in order to allow the tile spacer to be used as a spacer in a variety of gap spacing widths, the tile spacer also having a wedge for use on wall tile.

2. Background of the Prior Art

In laying tile, an installer lays an adhesive such as mastic on the installation surface and then places each tile down onto the adhesive. Once the tile is set, the spacing between the tiles is filled with grout. In order for a professional finish, it is critical that the grout lines of the finished job be of uniform thickness. In order to achieve this uniform spacing, it is critical that the distance between each tile is the same. To achieve this uniformity, the installer typically employs tile spacers throughout the job. The tile spacers all have the same thickness and are placed between adjacent tiles so that the spacers assure that their thickness is translated to the width of the grout line formed which is uniform throughout. Once the tile is set, the tile spacers are removed and reused on the next job.

Tile spacers are a tried and true method of achieving grout lines having a uniform width, however, they are not without drawbacks. Primary among the shortcomings of a typical tile spacer is the fact that different jobs require different grout line widths and sometimes within a given job, two or more grout widths are called for. For example, the main tiles of a job may have a relatively wide grout line and an accent strip of smaller tiles may call for a relatively narrow grout line. As such, the installer needs to have sufficient spacers on hand for each grout line width that the installer is working with. This requires that the installer keep numerous sizes of tile spacers on hand to assure that the installer has sufficient supply for any job that may be encountered. This creates an inventory control problem, especially if the customer has a last-minute change of heart and decides that they want to change the width of the grout line of the tile being installed. Additionally, if the various sizes of tiles spacers that the installer has on hand get mixed together, then the installer is faced with the time-consuming and frustrating task of separating the tile spacers based on their size.

To address these problems, tile spacers have been proposed that have two or more spacing sections, each targeted at a grout line of a different width. These multi-width spacers, which come in a wide variety of architectures and work with varying degrees of efficiency, are not without their own shortcomings. Some multi-width spacers are a generally cross-shaped or other three-dimensional shape so that such spacers cannot be used in any grout line that abuts against an object that is perpendicular to the tile laying surface, such as floor tiles abutting against a wall. Some multi-width tile spacers require a certain degree of skill and finesse to use so that the average homeowner may be excluded from their effective use and experienced installers tend to be slowed in their deployment so that the overall installation take longer than desired.

What is needed is a multi-width tile spacer that can be used for spacing tiles during installation and be able to be used for a variety of spacing widths. Such a tile spacer must be structured so that it can be used at virtually all locations including boundary areas such as floor tiles that abut against a wall. Such a tile spacer must be easy to use so that inexperienced users can competently use the spacer and professional installers can use the spacer without spending extra time during utilization of the spacer.

SUMMARY OF THE INVENTION

The tile spacer and wedge of the present invention addresses the aforementioned needs in the art by providing a tile spacer that has multiple working surfaces, each working surface used for a different spacing distance between tiles. The tile spacer and wedge is usable at virtually all grout line locations including at the boundary line between a horizontally laid tile and a vertical surface such as a wall. Use of the tile spacer is quick and easy, requiring no more skill or time investment than a typical single thickness tile spacer. The tile spacer and wedge of the present invention has the added feature of providing a wedge which is used to lay the first row of vertical tiles to assure a proper vertical alignment of the tiles being installed. The tile spacer and wedge of the present invention is of relatively simple design and construction, being produced using standard manufacturing techniques, so as to make the device relatively inexpensive to produce and thus economically attractive to potential consumers for this type of device.

The tile spacer and wedge of the present invention is comprised of a base member that has a truncated pentagon shape and has a flat lower surface and a corresponding upper surface. The base member has a first side edge that has a first thickness and a second side edge that has a second thickness greater than the first thickness, the two edges parallel with one another. The base member also has a back edge that connects the first side edge and the second side edge and a corresponding front edge that is parallel with the back edge. The front edge has a third thickness that is less than the first thickness. The base member also has a ridge that rises upwardly from the upper surface and straddles a midline of the base member, the midline extending between the front edge and the back edge and is parallel with the first side edge and the second side edge. The ridge has a ridge top face. The base member tapers downwardly in proceeding from the upper surface toward the lower surface and from a medial portion of the base member toward the front edge to thereby form a wedge. A generally rectangular solid shaped riser extends upwardly from a top of the ridge. The riser has a first riser side face facing the first edge and a corresponding second riser side face facing the second edge. The riser also has a flat riser top face and a flat riser back face that is flush with the back edge of the base member. The riser has a fourth thickness measured between the first riser side face and the second riser side face, this fourth thickness being greater than the second thickness. A generally rectangular solid shaped extension extends rearwardly from the riser back face. The extension has a flat extension top face that is flush with the riser top face. The extension has a first extension side face facing the first side edge and a second extension side face facing the second side edge. The extension has a flat extension back face that is parallel with the back edge. The extension has a fifth thickness measured between the first extension side face and the second extension side face, this fifth thickness being greater than the second thickness and less than the fourth thickness. The ridge may extend beyond the back edge of the base member and has a ridge bottom face that is flush with the lower surface of the base member. The ridge also has a thickness that is measured between the ridge top face and the ridge bottom face, this thickness being greater than the second thickness. A first diagonal edge connects the first edge with the front edge while a second diagonal edge connects the second edge with the front edge. The first diagonal edge tapers toward the second diagonal edge in proceeding toward the front edge and the second diagonal edge tapers toward the first diagonal edge in proceeding toward the front edge.

BRIEF DESCRIPTION OF THE DRAWINGS

Similar reference numerals refer to similar parts throughout the several views of the drawings.

DESCRIPTION OF THE PREFERRED EMBODIMENT

Figure 1:
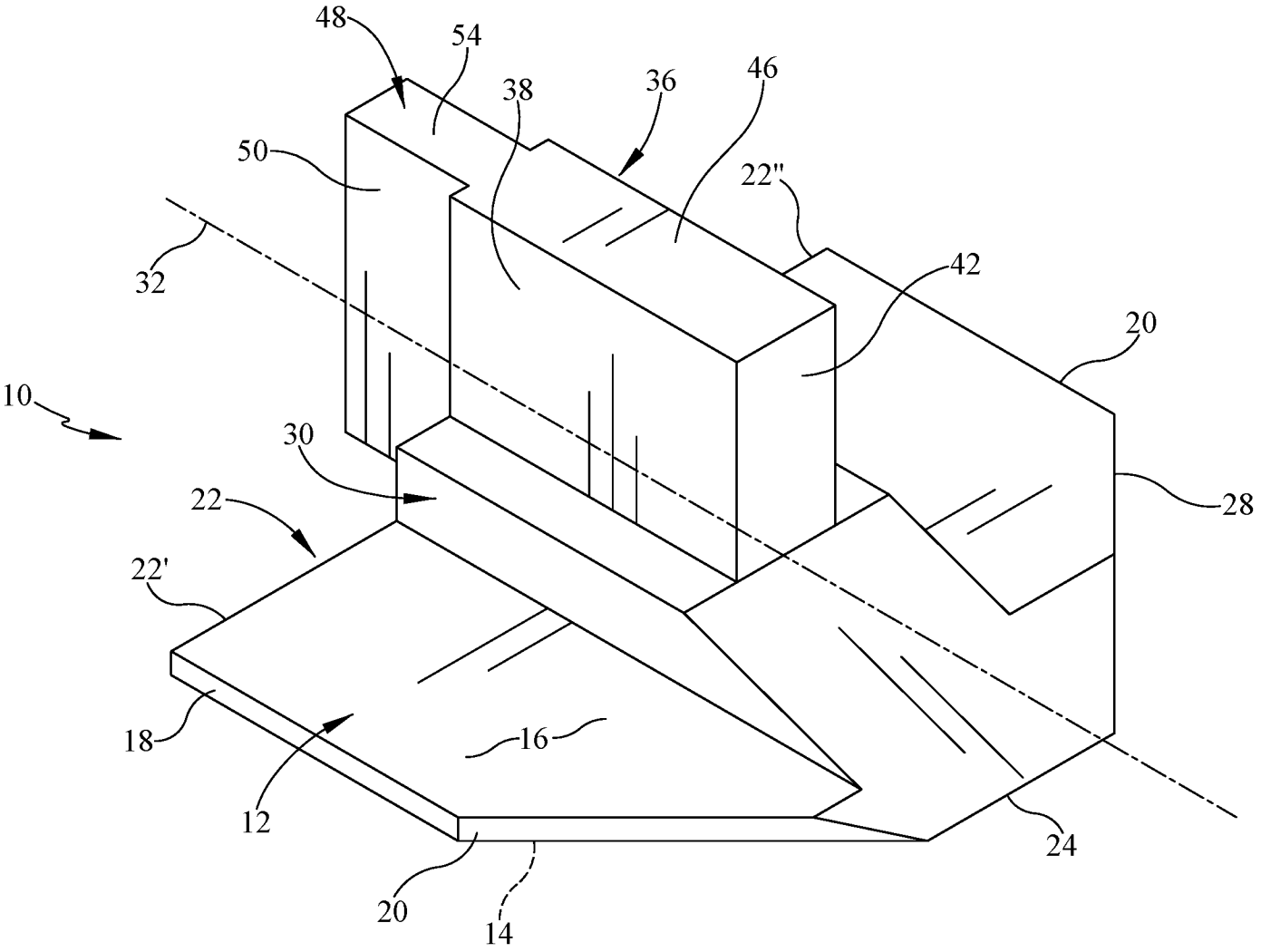
FIG. 1 is a perspective view of the tile spacer and wedge of the present invention.
Figure 2:
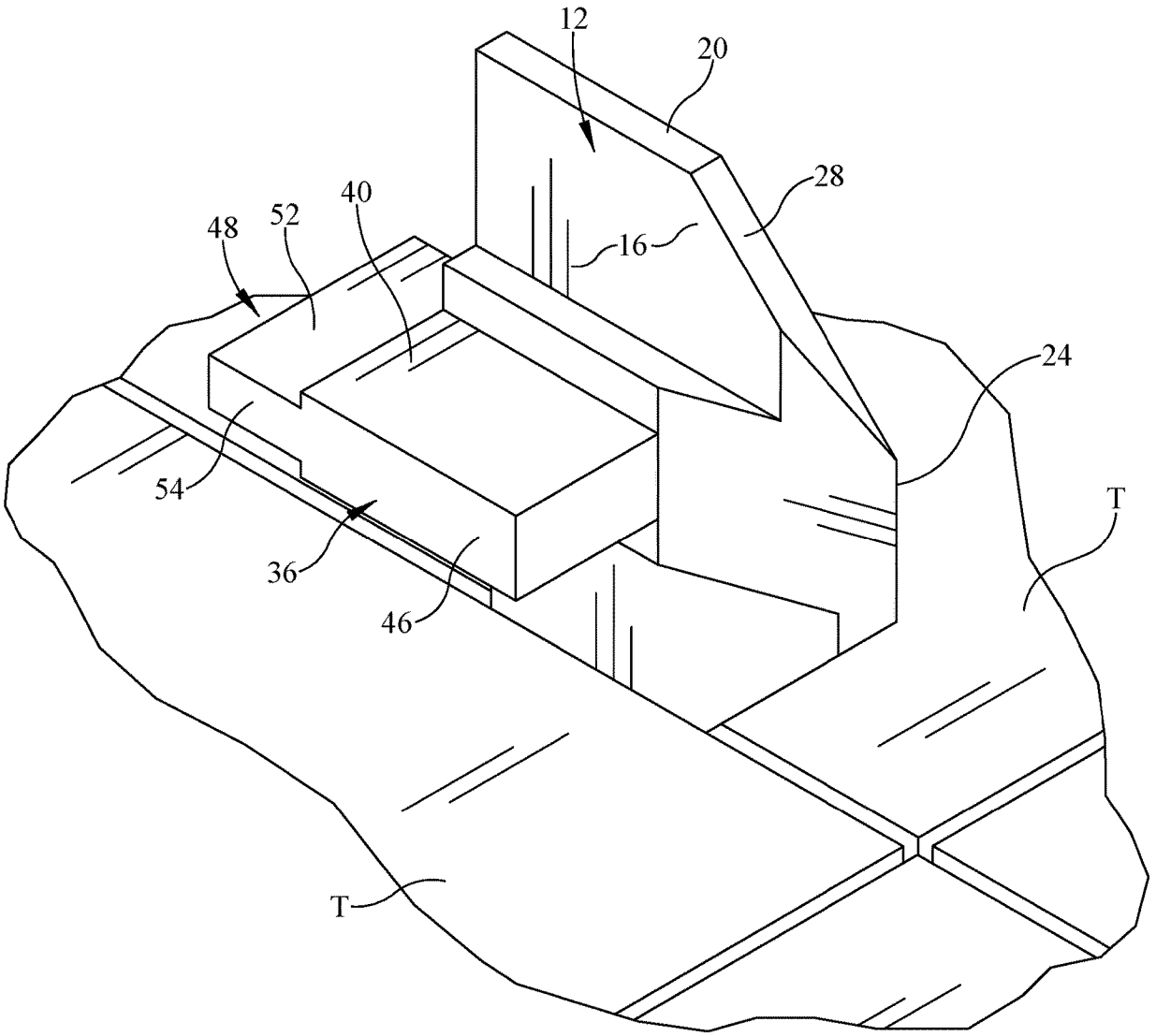
FIG. 2 is an environmental view of the tile spacer and wedge being used to space tile using a first spacing edge.
Figure 3:
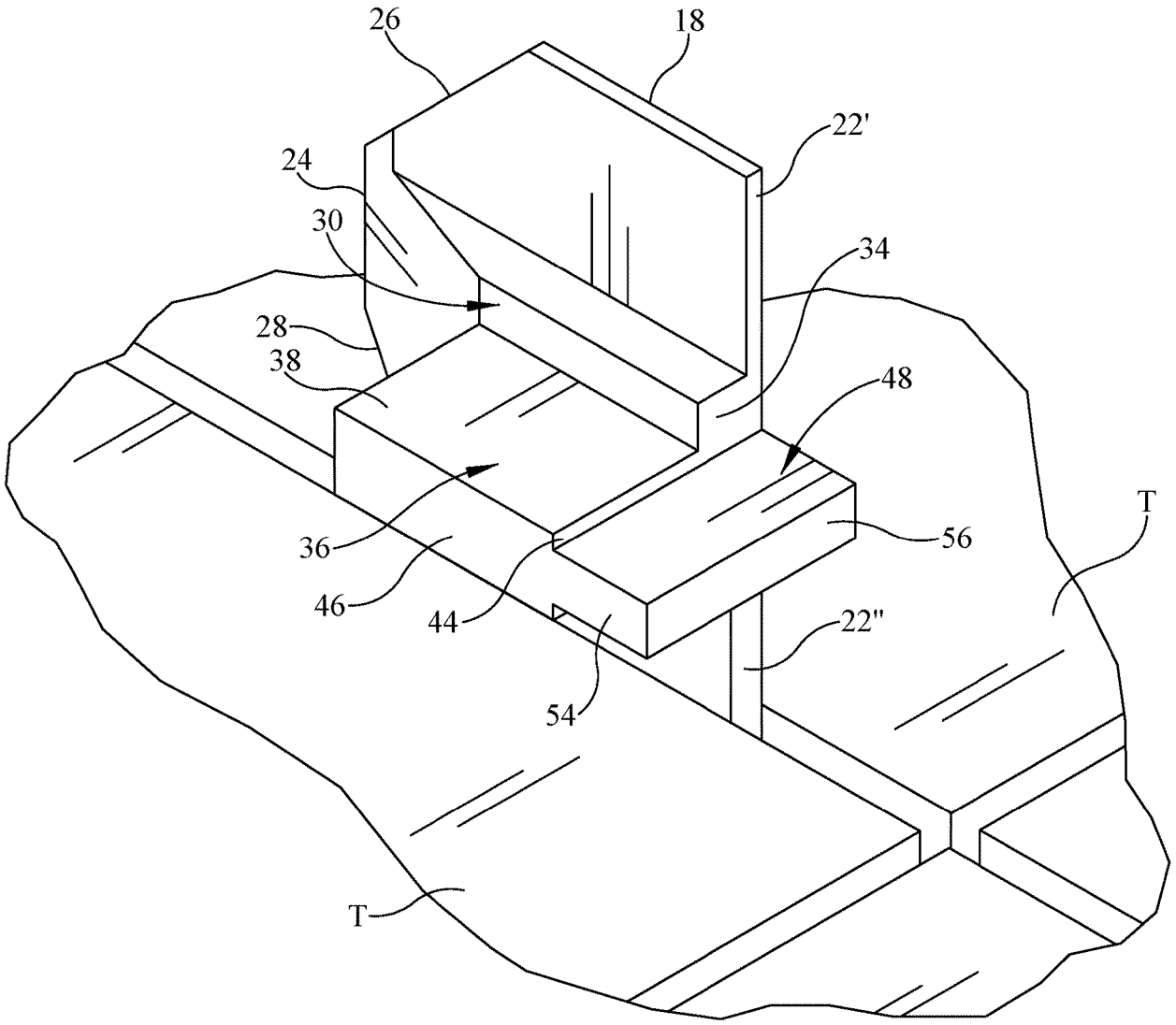
FIG. 3 is an environmental view of the tile spacer and wedge being used to space tile using a second spacing edge.
Figure 4:
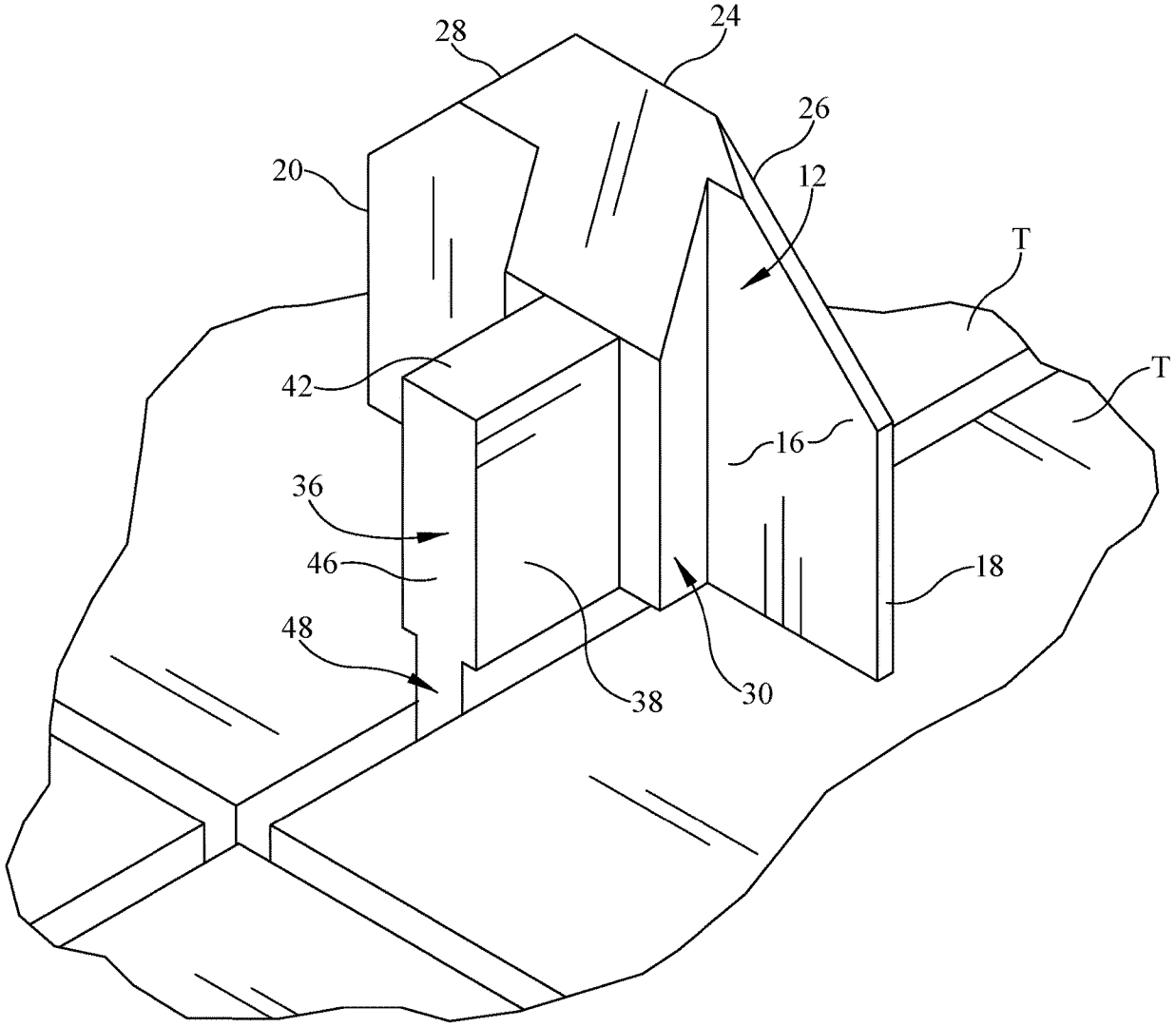
FIG. 4 is an environmental view of the tile spacer and wedge being used to space tile using a third spacing edge.
Figure 5:
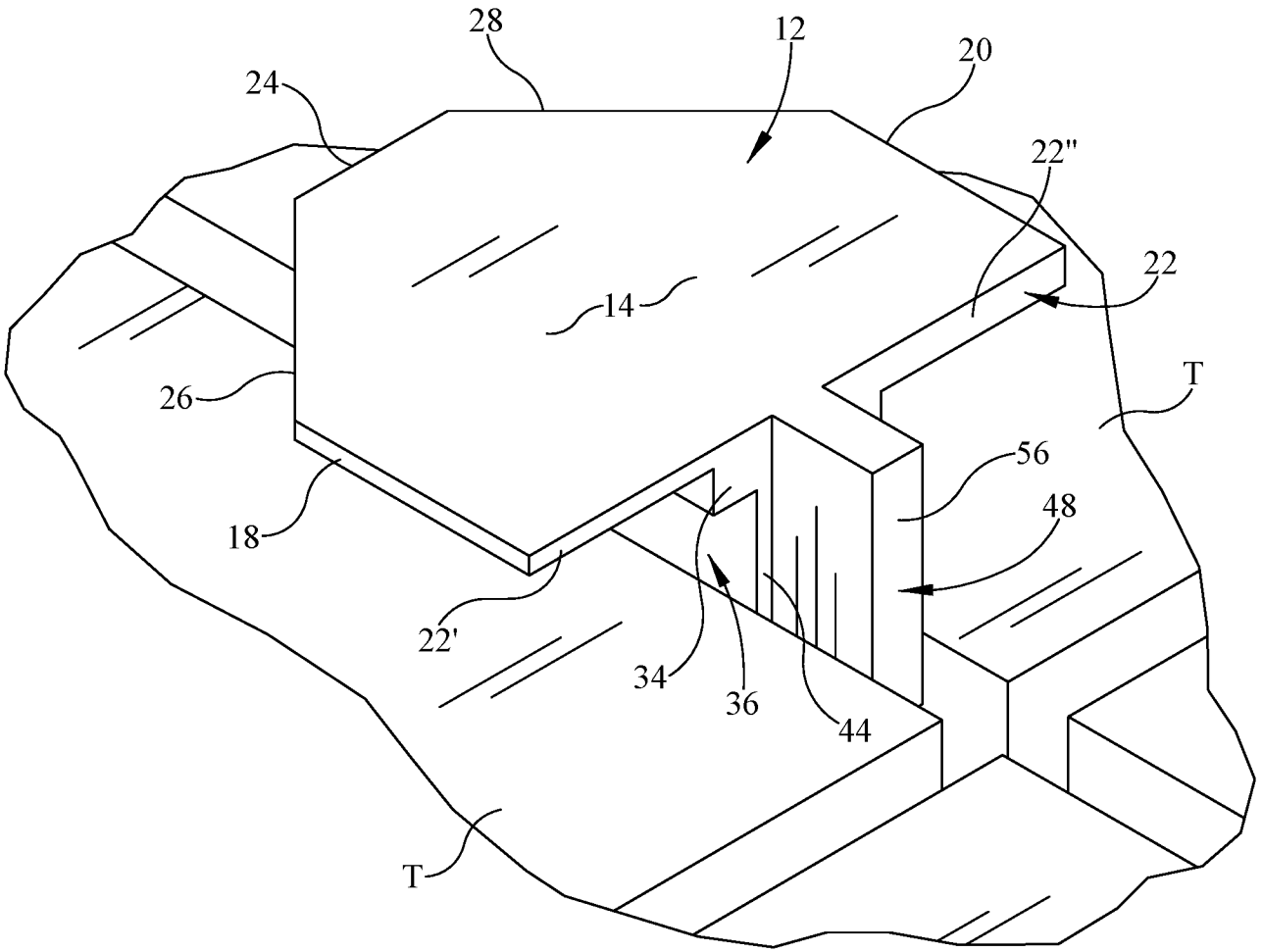
FIG. 5 is an environmental view of the tile spacer and wedge being used to space tile using a fourth spacing edge.
Figure 6:
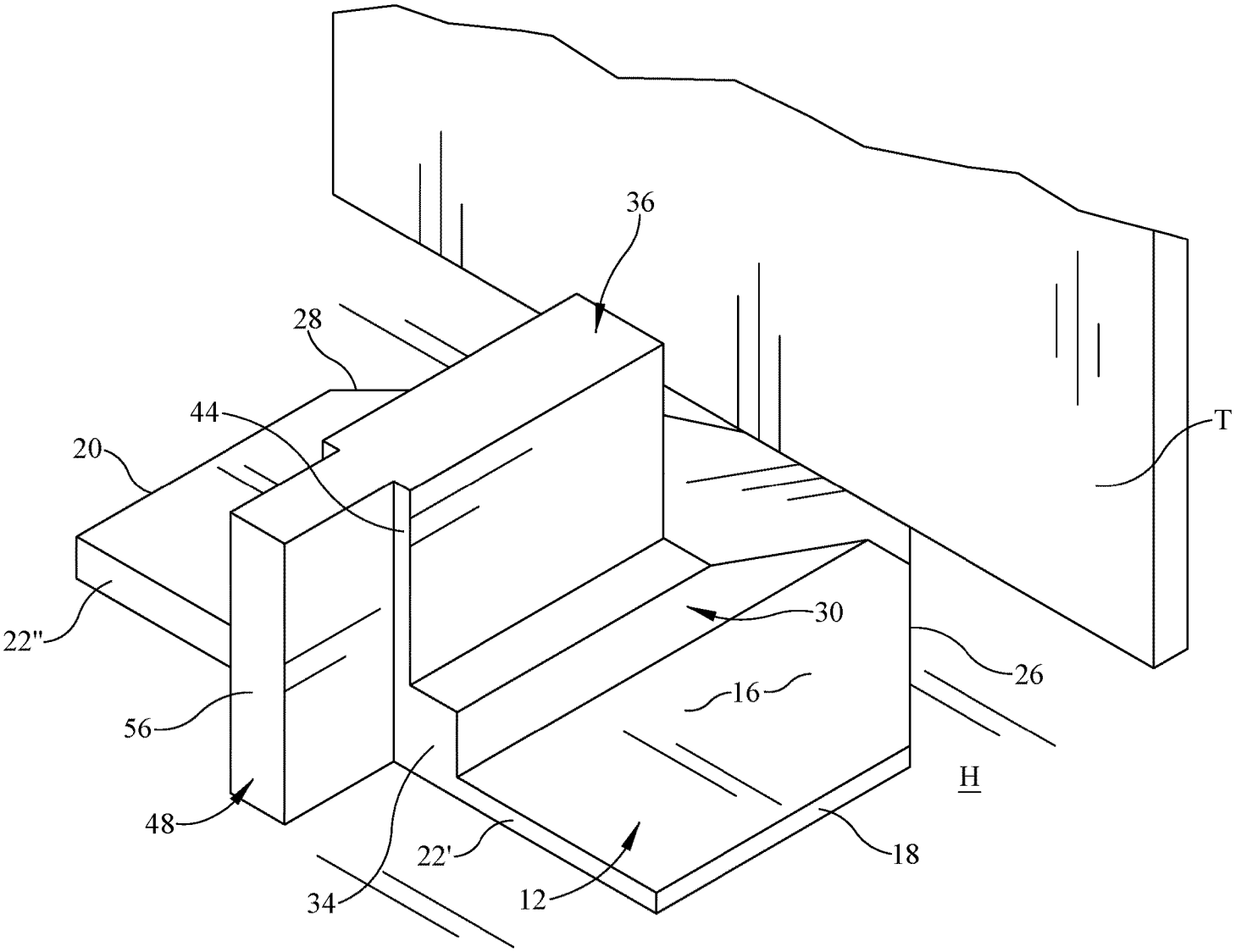
FIG. 6 is an environmental view of the tile spacer and wedge being used to space tile using the wedge.
Figure 11:
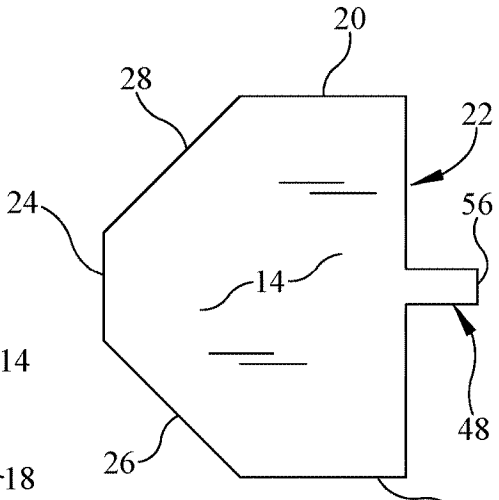
FIG. 11 is a bottom view of the tile spacer and wedge.
Figure 10:
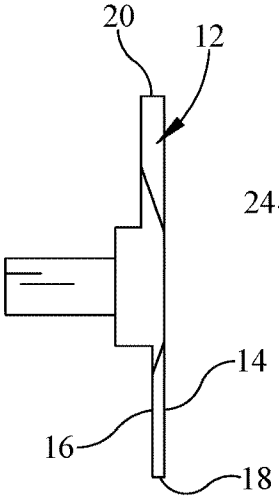
FIG. 10 is a front view of the tile spacer and wedge.
Figure 7:
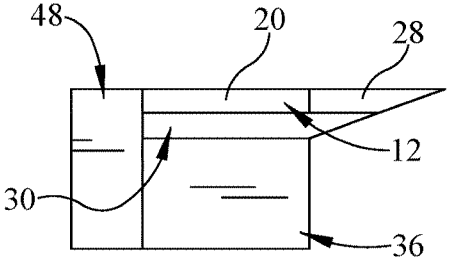
FIG. 7 is a first side view of the tile spacer and wedge.
Figure 9:
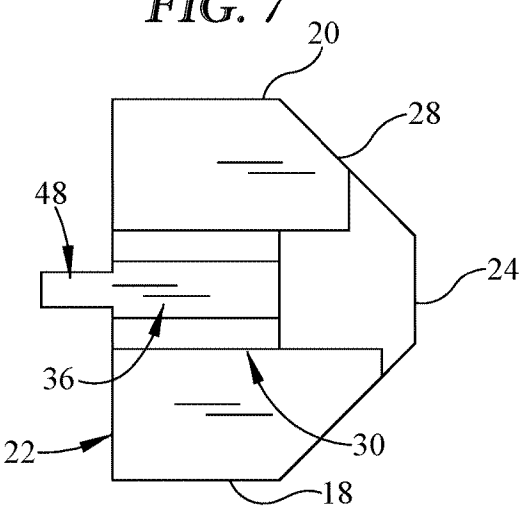
FIG. 9 is a top view of the tile spacer and wedge.
Figure 12:
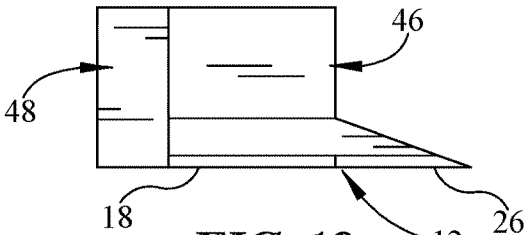
FIG. 12 is a second side view of the tile spacer and wedge.
Figure 8:
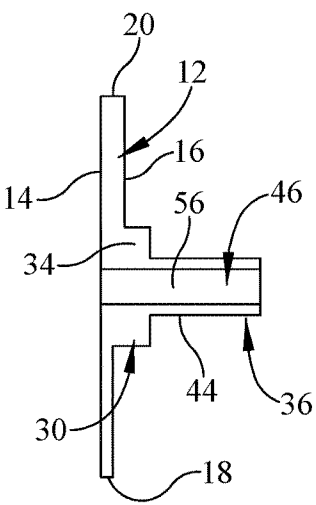
FIG. 8 is a rear view of the tile spacer and wedge.

Referring now to the drawings, it is seen that the tile spacer and wedge of the present invention, generally denoted by reference numeral 10, is comprised of a base member 12 that has a relatively flat lower surface 14 and a corresponding upper surface 16 which also advantageously flat. As seen, the base member 12 is in the shape of a truncated pentagon and has a first side edge 18 and a corresponding second side edge 20 joined by a back edge 22 and a corresponding front edge 24. A first diagonal edge 26 joins the first side edge 18 with the front edge 24 while a second diagonal edge 28 joins the second side edge 20 with the front edge 24. A generally rectangular shaped ridge 30 rises upwardly from the upper surface 16 of the base member 12 and straddles a midline 32 that passes between the front edge 24 and the back edge 22. The ridge 30 has a ridge back face 34 that is flush with the back edge 22. Extending upwardly from the ridge 30 is a generally rectangular solid shaped riser 36 that has a first riser side face 38 facing toward the first side edge 18 and a corresponding second riser side face 40 facing toward the second side edge 20. The riser 36 also has a riser front face 42 facing the front edge 24 and a corresponding riser back face 44 that is flush with the ridge back face 34 and the back edge 22. The riser 36 also has a riser top face 46. Extending rearwardly from the riser back face 44 is a generally rectangular solid shaped extension 48 that has a first extension side face 50 facing the first side edge 18 and a corresponding second extension side face 52 facing the second side edge 20. The extension 48 also has an extension top face 54 that is flush with the riser top face 46. The extension also has an extension back face 56 that is parallel with the back edge 22.

The base member 12 is formed as a unitary (indeed monolithic) unit from an appropriate material such as plastic, silicone, etc.

The first side edge 18 and its first section 22' of the overall back edge (the portion of the overall back edge 22 that is located between the ridge 30 and the first side edge 18) has a first thickness while the second side edge 20 and its second section 22" of the overall back edge (the portion of the overall back edge 22 that is located between the ridge 30 and the second side edge 20) has a second thickness that is greater than the first thickness. The riser 36 has a third thickness (measured between the first riser side face 38 and the second riser side face 40) that is greater than the second thickness. The extension 48 has a fourth thickness (measured between the first extension side face 50 and the second extension side face 52) which is greater than the second thickness but less than the third thickness.

As seen, the forward part of the base member 12 (proximate the front edge 24) is tapered downwardly in proceeding from the upper surface 16 toward the lower surface 14 and proceeding from a medial portion of the base member 12 toward the front edge 24 so that the front edge 24 has a fifth thickness that is less than the first thickness. As seen, the tapering, which forms the wedge portion of the tile spacer and wedge 10, results in the forward portion of the first diagonal edge 26 having a varying thickness that is less than the thickness of the first side edge 18, otherwise the remainder of the first diagonal edge 26 has the same thickness as the first side edge 18. Similarly, the forward portion of the second diagonal edge 28 has a varying thickness that is less than the thickness of the second side edge 20, otherwise the remainder of the second diagonal edge 28 has the same thickness as the second side edge 20. The tapering may impact onto the ridge 30 and possibly the riser 36 depending on the overall dimensions of the tile spacer and wedge 10 and the degree of taper.

In order to use the tile spacer and wedge 10 of the present invention, either the first side edge 18, the second side edge 20, the riser 36, or the extension 48 is selected for use as a spacer, the selection dependent on the desired distance between adjacent tiles T. The portion that is selected to act as a spacer is inserted between two adjacent tiles T in the usual way. If the first side edge 18 is used as the spacer, then the first side edge 18 is inserted into the space between the tiles T. If need be, the ridge 30 acts as a stop to prevent over insertion of the tile spacer and wedge 10. Similarly, if the second side edge 20 is used as the spacer, then the second side edge 20 is inserted into the space between the tiles T. If need be, the ridge 30 acts as a stop to prevent over insertion of the tile spacer and wedge 10. If the riser 36 is selected as the spacer, then the riser 36 is inserted into the space between the tiles T riser top face 46 first. If the extension 48 is selected as the spacer, then the extension 48 is inserted into the space between the tiles T extension back face 56 first. If the wedge portion of the tile spacer and wedge 10 is used, then the nose of the device is utilized with the front edge 24 inserted underneath the bottom tile T and the horizontal surface H in the usual way.

Figure 13:
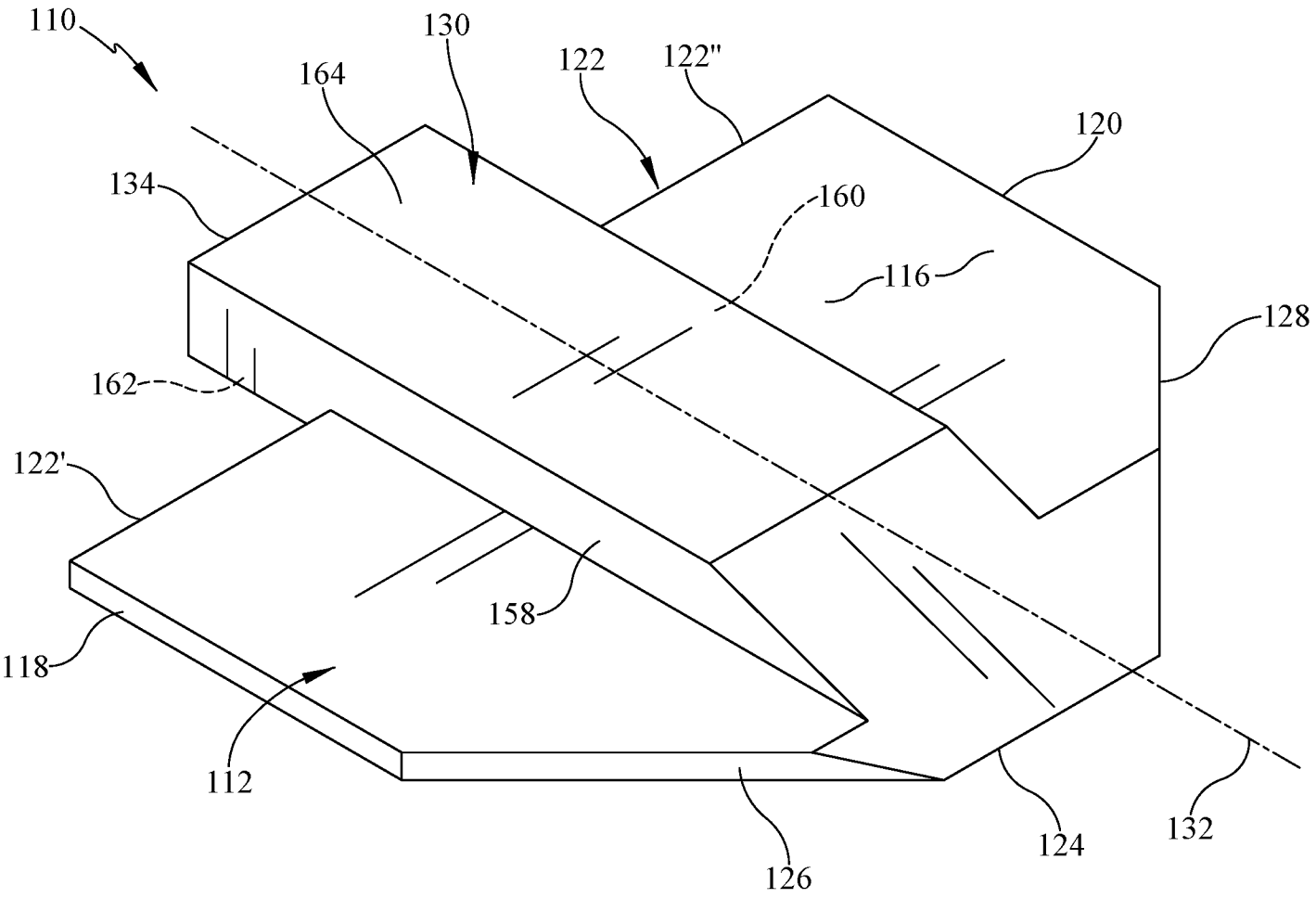
FIG. 13 is a perspective view of an alternate embodiment of the tile spacer and wedge of the present invention.
Figure 14:
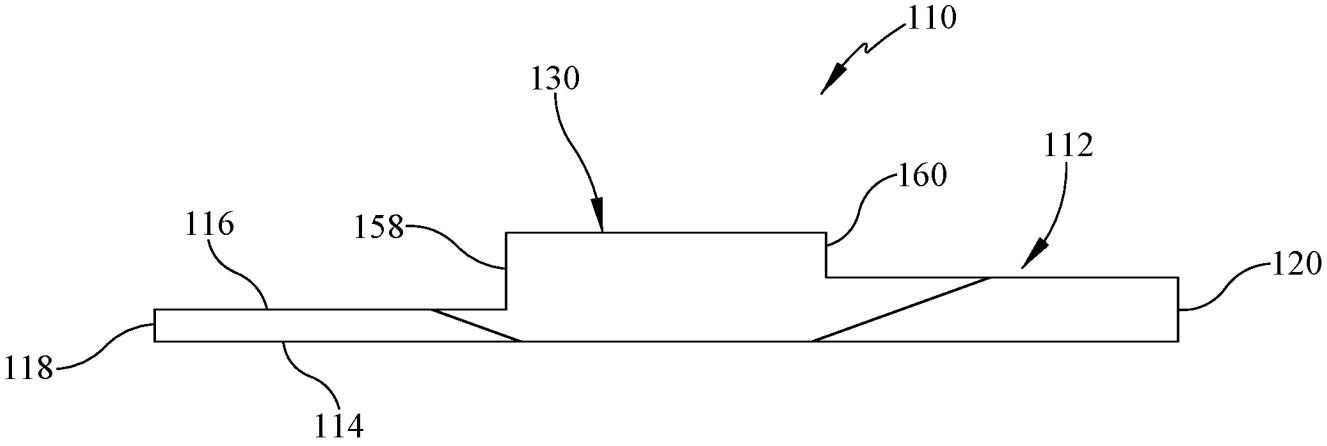
FIG. 14 is a front view of the tile spacer and wedge of FIG. 13.

As in FIGS. 13 and 14, in an alternate embodiment of the tile spacer and wedge 110 of the present invention, generally denoted by reference number 110, the riser and extension can be eliminated for a more simple device so that the tile spacer and wedge is comprised of a base member 112 that has a relatively flat lower surface 114 and a corresponding upper surface 116. As seen, the base member 112 is in the shape of a truncated pentagon and has a first side edge 118 and a corresponding second side edge 120 joined by a back edge 122 and a corresponding front edge 124. A first diagonal edge 126 joins the first side edge 118 with the front edge 124 while a second diagonal edge 128 joins the second side edge 120 with the front edge 124. A generally rectangular solid shaped ridge 130 rises upwardly from the upper surface 116 of the base member 112 and straddles a midline 132 that passes between the front edge 124 and the back edge 122. The ridge 130 extends beyond the back edge 122. The ridge 130 has a first ridge side face 158 that faces the first side edge 118 and a corresponding second ridge side face 160 that faces the second side edge 120. The ridge 130 also has a ridge back face 134 that is parallel with the back edge 122 and a ridge bottom face 162 that is flush with the lower surface 114 and a corresponding ridge top face 164.

The base member 112 is formed as a unitary (indeed monolithic) unit from an appropriate material such as plastic, silicone, etc.

The first side edge 118 and its first section 122' of the overall back edge (the portion of the overall back edge 122 that is located between the ridge 130 and the first side edge 118) has a first thickness while the second side edge 120 and its second section 122" of the overall back edge (the portion of the overall back edge 122 that is located between the ridge 130 and the second side edge 120) has a second thickness that is greater than the first thickness. The ridge 130 has a third thickness (measured between the top face 164 and the ridge bottom face 162) that is greater than the second thickness.

As seen, the forward part of the base member 112 (proximate the front edge 124) is tapered downwardly in proceeding from the upper surface 116 toward the lower surface 114 and proceeding from a medial portion of the base member 112 toward the front edge 124 so that the front edge 124 has a fourth thickness that is less than the first thickness. As seen, the tapering, which forms the wedge portion of the tile spacer and wedge 110, results in the forward portion of the first diagonal edge 126 having a varying thickness that is less than the thickness of the first side edge 118, otherwise the remainder of the first diagonal edge 126 has the same thickness as the first side edge 118. Similarly, the forward portion of the second diagonal edge 128 has a varying thickness that is less than the thickness of the second side edge 120, otherwise the remainder of the second diagonal edge 128 has the same thickness as the second side edge 120. The tapering may impact onto the ridge 130 depending on the overall dimensions of the tile spacer and wedge 110 and the degree of taper.

In order to use the tile spacer and wedge 110 of the present invention, either the first side edge 118, the second side edge 120 or the ridge 130 is selected for use as a spacer, the selection dependent on the desired distance between adjacent tiles T. The portion that is selected to act as a spacer is inserted between two adjacent tiles T in the usual way. If the first side edge 118 is used as the spacer, then the first side edge 118 is inserted into the space between the tiles T. If need be, the ridge 130 acts as a stop to prevent over insertion of the tile spacer and wedge 110. Similarly, if the second side edge 120 is used as the spacer, then the second side edge 120 is inserted into the space between the tiles T. If need be, the ridge 130 acts as a stop to prevent over insertion of the tile spacer and wedge 110. If the ridge 130 is selected as the spacer, then the ridge 130 is inserted into the space between the tiles T ridge back face 134 first with the ridge bottom face 162 and the ridge top face 164 abutting the tiles T (or boundary surface). If the wedge portion of the tile spacer and wedge 110 is used, then the nose of the device is utilized with the front edge 124 inserted underneath the bottom tile T and the horizontal surface H in the usual way.

While the invention has been particularly shown and described with reference to an embodiment thereof, it will be appreciated by those skilled in the art that various changes in form and detail may be made without departing from the spirit and scope of the invention.

We claim:

1. A tile spacer comprising:

a base member having a truncated pentagon shape and having a flat lower surface and a corresponding upper surface, the base member also having a first side edge that has a first thickness and a second side edge that has a second thickness greater than the first thickness, the base member also having a back edge that connects the first side edge and the second side edge, the base member also having a corresponding front edge that is parallel with the back edge, the front edge having a third thickness that is less than the first thickness, the base member also having a ridge rising upwardly from the upper surface and straddling a midline of the base member, the midline extending between the front edge and the back edge and being parallel with the first side edge and the second side edge, the ridge having a ridge top face; and wherein the base member tapers downwardly in proceeding from the upper surface toward the lower surface and from a medial portion of the base member toward the front edged to thereby form a wedge.

2. The tile spacer as in claim 1 further comprising a generally rectangular solid shaped riser extending upwardly from a top of the ridge, the riser having a first riser side face facing the first edge and a corresponding second riser side face facing the second edge, the riser also having a flat riser top face and a flat riser back face that is flush with the back edge of the base member, such that the riser has a fourth thickness measured between the first riser side face and the second riser side face, the fourth thickness being greater than the second thickness.

3. The tile spacer as in claim 2 further comprising a generally rectangular solid shaped extension extending rearwardly from the riser back face, the extension having a flat extension top face that is flush with the riser top face, the extension having a first extension side face facing the first side edge and a second extension side face facing the second side edge, the extension having a flat extension back face that is parallel with the back edge of the base member, the extension having a fifth thickness measured between the first extension side face and the second extension side face, the fifth thickness being greater than the second thickness and less than the fourth thickness.

4. The tile spacer as in claim 1 wherein the ridge extends beyond the back edge of the base member and has a ridge bottom face that is flush with the lower surface of the base member, the ridge having a fourth thickness measured between the ridge top face and the ridge bottom face, the fourth thickness being greater than the second thickness.

5. The tile spacer as in claim 1 wherein the base member has a first diagonal edge that connects the first side edge with the front edge and a second diagonal edge that connects the second side edge with the front edge.

6. The tile spacer as in claim 5 wherein the first diagonal edge tapers toward the second diagonal edge in proceeding toward the front edge and the second diagonal edge tapers toward the first diagonal edge in proceeding toward the front edge.

* * * * *